United States Patent [19]

Talmage et al.

[11] 4,076,406

[45] Feb. 28, 1978

[54] METHOD OF AND APPARATUS FOR TONING ELECTROPHOTOGRAPHIC FILM

[75] Inventors: Peter Guy Talmage; Manfred Rudolf Kuehnle, both of Lexington, Mass.

[73] Assignee: Coulter Information Systems, Inc., Bedford, Mass.

[21] Appl. No.: 693,631

[22] Filed: Jun. 7, 1976

Related U.S. Application Data

[63] Continuation-in-part of Ser. No. 523,370, Nov. 13, 1974, abandoned.

[51] Int. Cl.[2] ..... G03G 15/10

[52] U.S. Cl. ..... 355/10; 96/1 LY; 118/647; 118/DIG. 23; 427/17

[58] Field of Search ..... 355/3 R, 10, 3 SH; 96/1 LY; 427/15, 17; 118/647, DIG. 23

[56] References Cited

U.S. PATENT DOCUMENTS

| | | | |
|---|---|---|---|
| 3,155,546 | 11/1964 | Dirks | 118/DIG. 23 |
| 3,256,855 | 6/1966 | Oliphant | 118/647 |
| 3,345,925 | 10/1967 | Ostensen | 118/DIG. 23 |
| 3,703,399 | 11/1972 | Tanaka et al. | 355/10 X |

*Primary Examiner*—Richard L. Moses
*Attorney, Agent, or Firm*—Silverman & Cass, Ltd.

[57] ABSTRACT

A method of and apparatus for toning an exposed electrophotographic member in a camera or other electrostatic imaging device which uses liquid toner comprising toner particles suspended in a dispersant.

The method contemplates running the liquid toner into a chamber containing the photoconductive surface of the electrophotographic member and a metal plate parallel with one another and spaced apart as two boundaries of the chamber. During the toning operation, a low d.c. bias is applied across the chamber between the photoconductive surface and the plate of a polarity opposite to that characterizing the latent image such as to repel toner particles from the photoconductive surface, but the voltage of the bias is low enough not to affect increments of the surface which have substantial charge on them. The result is that said increments with very little charge are left with practically no adhering particles. When the toning is completed, the bias is substantially increased to cause strong attraction to the plate so that any particles floating in the liquid toner which have not adhered to the photoconductive surface tend to collect on the plate. Since the other particles have adhered to the latent image on the photoconductive surface, the toner is cleared of floating particles and can be run out of the chamber leaving the toned image clean of particles in the untoned so called background areas.

19 Claims, 8 Drawing Figures

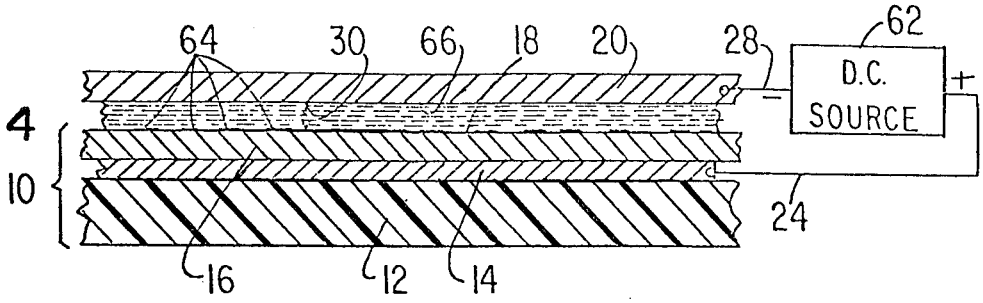
FIG. 4
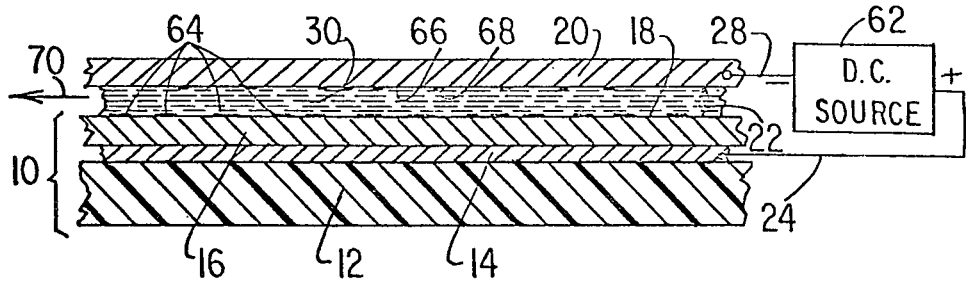
FIG. 5
FIG. 6
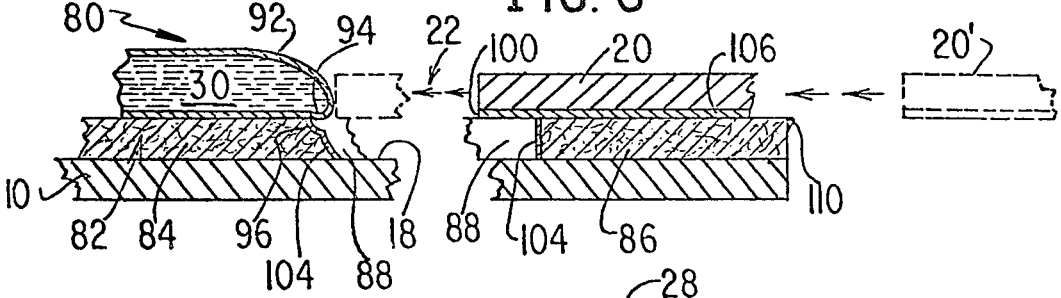
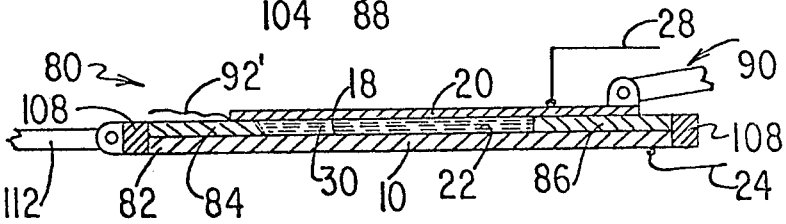
FIG. 7
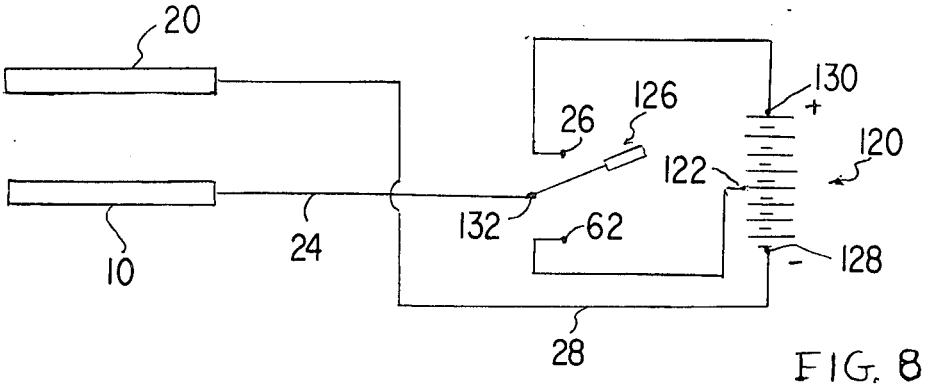
FIG. 8

METHOD OF AND APPARATUS FOR TONING ELECTROPHOTOGRAPHIC FILM

CROSS-REFERENCE TO RELATED APPLICATIONS

This is a continuation-in-part application based on pending patent application Ser. No. 523,370 filed Nov. 13, 1974 now abandoned by the applicant entitled "METHOD OF AND APPARATUS FOR TONING ELECTROPHOTOGRAPHIC FILM."

Reference will be made hereinafter to application Ser. No. 434,699 filed Jan. 17, 1974 filed by the applicant and entitled "Electrophotographic Film, Method of Making and Using the Same and Photoconductive Coating Used Therewith."

BACKGROUND OF THE INVENTION

The invention herein is concerned primarily with a method of and apparatus for toning electrophotographic film.

The field of toning has become important in recent years in connection with the increasing use of electrostatic techniques for reproducing drawings and documents and even more recently in the imaging of scenes directly, as the equivalent of conventional silver halide photography carried out under varying conditions of light and at high speeds.

According to the basic concept of electrostatic imaging, a photoconductive member is charged by corona or the like in darkness and its surface which has been charged is then illuminated by a light pattern of that which it is desired to reproduce. The charge is selectively dissipated by the projected light pattern, being permitted to remain at those surface increments of the photoconductive member which are not illuminated and being removed from those surface increments which are illuminated. As a general rule the degree of dissipation is directly related to the degree of illumination. In this manner there is produced a latent charge image of the pattern on the surface of the photoconductive member which slowly fades as the charge continues to leak off from the charged increments.

Without detailing the theory of operation of this technology, it should be noted in passing that the ability of a photoconductive member to retain a latent image with surface increments side by side having different degrees of charge is a function of its electrical anisotropy. The resolution capable of being achieved is a function of the size of the increments which in turn depends upon the material or materials from which the photoconductive member is made. The range of charges is a direct measure of the grey scale capabilities, and this in turn is controlled by the difference between light and dark resistivities. The speed with which a latent image can be formed is a measure of the gain of the photoconductive member or the response of the recombining of charges due to photons projected to the member.

The electrophotographic member which is disclosed in the above-mentioned application Ser. No. 434,699 is an example of a high speed, high resolution article which is well suited for use in connection with the invention herein.

According to the techniques of modern electrostatic technology, before the latent image has materially deteriorated, a comminuted powder of carbon, resin or the like is dusted, rubbed or flowed onto the surface of the photoconductive member. This material is called "toner" in whatever form it may be. The particles which make up this material are charged oppositely to the polarity of the charges which remain on the surface of the electrophotographic member by tribolectric or electrophoretic influence of other particles, solvents and the like. On this account, the toner particles will adhere in proportion to the degree of charge remaining on the charged increments after exposure and thus, the latent image is converted into a visible image.

Where the toner particles are suspended in a liquid, the toner may be viewed as a type of ink comprising toner particles and dispersant. Since wetting is usually desirable for liquid toner, low surface tension liquids such as hydrocarbons are typically used as dispersants. These have the added advantage of being insulative so that the charge of the particles is preserved. One such hydrocarbon which is an isoparaffinic hydrocarbon fraction is available in various grades from Exxon Company of Houston, Tex. as "Isopar." The dispersant will electrophoretically affect the particles giving them a charge polarity, and in the case of Isopar it will be positive. This is ideal for the electrophotographic member of the above-mentioned application Ser. No. 434,699 when it is formed of the preferred photoconductive coating of ultrapure crystalline cadmium sulfide, either doped or undoped, since cadmium sulfide is an n-type material. The charge initially applied to the latter is achieved by electrons which are introduced into or below the surface so that the latent image is formed of negatively charged increments resulting from the fields apparent at the surface due to the presence of the electrons.

Two forms of electrostatic techniques are in wide spread use at the present time, one being known as xerography in which the photoconductive coating of the electrophotographic member is a layer of amorphous selenium carried on an aluminum drum. This first type of technique involves charging the selenium surface with a positive charge through corona and, after exposure, toning by means of dry toner particles mixed with resin. The method is known as "cascade toning" and is done in an enclosed chamber which confines the powder, recirculates it, etc. Various schemes involving the use of electrodes arranged opposite to the drum within the chamber are used to achieve increased efficiency during toning.

In xerography, the toned image carried on the drum is transferred to paper by pressure, and in some instances, the application of a low voltage bias, after which the drum is cleaned for reuse, while the transferred image is fused permanently in place by heat.

The second form of electrostatic techniques in use at this time is known as electrofax. The electrophotographic member in this case is a sheet of conductive paper having a coating of zinc oxide in a matrix of resin as the photoconductive layer. The imaging is effected by charging the surface negatively and, after exposure, the entire sheet is drawn through a liquid toner bath carrying toner particles in a dispersant. The toner adheres and is fused directly to the surface of the electrophotographic member whereby the latter member itself becomes the final copy of the document which has been reproduced.

The electrophotographic member of the co-pending application Ser. No. 434,699 affords a new electrostatic technique which has many advantages over known technology. As stated above, the photoconductive coating of this electrophotographic member is capable of being imaged at very high speed with great resolution. The member is formed of a substrate of polymeric organic transparent sheeting having a thin film layer of ohmic material about 300 to 500 Angstroms thick deposited on one surface and a thin film coating of the photoconductive material mentioned, preferably cadmium sulfide, sputter deposited on top of the ohmic layer. The thickness of the photoconductive layer is about 3500 Angstroms and it is a crystalline, dense, wholly inorganic, abrasion-resistant material which is quite transparent. Details of its characteristics are to be found in the said copending application Ser. No. 434,699.

Of the many functional characteristics of the material, three comprise its high speed, its high resolution and its ability to discharge to practically zero surface potential. Extremely efficient and highly sensitive toner with very fine particles is used in the imaging of this photoconductive material by means of which there is achieved the high resolution of which the material is capable. Absent residual voltage, backgrounds can be absolutely devoid of pigment, but in cases where even minute voltages remain, fog develops in the otherwise pigment-free background of resulting images. Conventional electrostatic reproduction has background fogging inherently because there is always a noise voltage, but there is practically no noise voltage in connection with the film of the copending application. High quality reproduction and imaging of scenes should thus be possible with such film but is not always achieved because of minute potentials attracting small amounts of toner particles.

The invention seeks to minimize fogging of this nature.

Another source of fogging is especially noted in cases where the toning is effected by a liquid toner flooded onto a film and then expected to evaporate or be swept from the surface. In this case, even if the toner is physically swept or decanted off the charged surface, there will usually be a liquid film of dispersant on the surface that contains toner particles that precipitate onto the surface when the dispersant finally evaporates. Such particles are not attracted to areas of very low or even zero surface potential, but literally "fall" onto the surface mechanically when they come out of suspension. Prior to this they are "floating" in the dispersant.

This is probably the most important problem to be solved by the invention. The solution is not linked to its application only to the electrophotographic film of copending application Ser. No. 434,699 but may be applied to any technique involving electrophotographic members where the charged surface is to be toned by liquid toner. The former case needs the invention more because the film of said copending application has greater capabilities which may not fully be realized but for this invention.

It is clear, of course, that the problem in the case of floating particles of toner can be solved by applying toner for the time needed to achieve a good image and then applying a clear rinse of the same dispersant which was used to make the toner suspension to wash the remanent toner away. Obviously, this is time consuming and expensive. In the case of a small hand-held camera to be used for scene imaging equivalent to candid photography, for example, the complexity of the mechanism to effect toning would be greatly increased if rinsing had to be included in the functions performed. This would increase size and expense.

By the invention it is feasible to "wash" the toner particles away from the film through the use of a highly simplified method using economical apparatus that will not materially affect the size or expense of a camera, or complicate its structure. This method involves no dispersant flow or movement.

SUMMARY OF THE INVENTION

Method of toning an electrophotographic member having an ohmic layer and whose photoconductive surface has been charged and imaged to provide a latent charge image. The photoconductive coating is confined in a chamber and a metal image intensification plate brought into juxtaposition to but spaced from the photoconductive surface to form one boundary of the chamber. The metal plate is connected in a d.c. bias circuit which is also connected to the ohmic layer of the electrophotographic member placing a small voltage between the plate and the photoconductive surface across the chamber between plate and the surface. The bias voltage is chosen of a polarity to repel toner particles which normally are intended to be attracted to the photoconductive surface. Where the particles are positive and the charge is negative, the ohmic layer is at a positive potential above the plate. After the bias voltage across the chamber is established, the toner is introduced and permitted to remain for a length of time needed to tone the latent image. Increments of very little original charge according to the latent image, such as for example those which received the maximum of illumination, will for the most part just repel the positively charged toner particles in the liquid toner.

Just before the liquid of the toner is drawn out of the chamber, but after the toning has been effected, the bias is increased so that particles floating in the liquid toner in the chamber and which have not in the meantime been attracted to the photoconductive surface will move toward the inner surface of the plate. This assumes positive particles. Thereafter the liquid remaining in the chamber is withdrawn therefrom.

The apparatus of the invention provides means to support the electrophotographic film in a manner which will produce a chamber above the photographic surface when the image intensification plate is brought into position and means to move the plate and the electrophotographic film relative one another to achieve this after the film has been exposed. Means are provided to connect the ohmic layer of the electrophotographic film to the positive side of a d.c. potential source and the plate simultaneously to the negative side; and means are provided to increase the bias potential after the toning has occurred, but before the liquid is drawn out of the chamber.

Means are provided to run the liquid toner into the chamber which is formed and to remove it. Other structure will be described.

It is pointed out that where the photoconductive coating is p-type material the charge will be primarily positive, the toner particles negative, the image intensification bias will connect the negative side of a d.c. potential source to the ohmic layer and the plate will be connected to the positive side. Then, after toning but before removing the dispersant, the bias potential will be increased.

BRIEF DESCRIPTION OF THE DRAWINGS

FIG. 4 is a view similar to that of FIG. 2 but showing the "clearing" step of the method of the invention;

FIG. 5 is a view similar to that of FIG. 4 showing the last step of the method of the invention;

FIGS. 6 and 7 are fragmentary sectional views through apparatus embodying the invention; and FIG. 8 is a circuit diagram of a switching arrangement for use with the apparatus of the invention.

DESCRIPTION OF THE PREFERRED EMBODIMENTS

As mentioned, the invention hinges upon the use of controlled repulsion and attraction of toner particles to cause desired movement of the particles away from the film surface.

Initially the invention and its principles will be explained in connection with the diagrams of FIGS. 1 to 5 inclusive, showing the conditions existing in an apparatus such as a camera while the various steps of the method are carried out.

Figure 1:
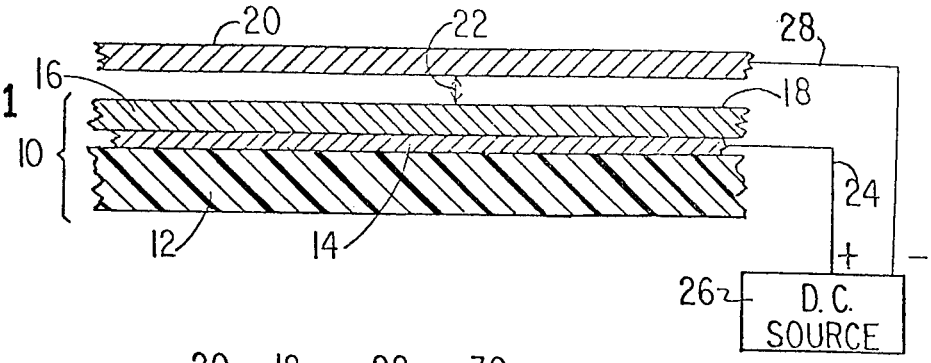
FIG. 1 is a diagrammatic sectional view through a fragment of an electrophotographic film in relationship to apparatus for carrying out the method of the invention, showing the first step of the method.

In FIG. 1 there is shown an electrophotographic member 10 which is formed according to the invention of the copending application Ser. No. 434,699 but it should be clear that this is only by way of example, since the application is capable of being practiced with other electrophotographic members. The substrate 12 is a sheet of organic polymer material that is transparent and clean, such as polyethylene terphthalate (Mylar - DuPont) about .005 inch thick having an ohmic layer 14 deposited on the surface and a photoconductive coating 16 deposited onto the ohmic layer 14. The ohmic layer in one example is indium-tin oxide about 300 to 500 Angstroms thick, while the coating 16 is sputtered crystalline cadmium sulfide about 2000 to 4000 Angstroms thick.

The photoconductive member 16, through its surface 18 may be presumed to have been charged to a suitable voltage and maintained in darkness to provide negative charges evenly distributed at or near the surface (the cadmium sulfide being n-type semi-conductor material) and exposed to a projected light pattern to produce a latent charge image on the surface. It is now desired to tone the latent image to render it visible. The apparatus includes a conductive plate 20 of any suitable metal that is arranged parallel with and spaced from the surface 18 of the photoconductive coating 16. There can be some kind of framing border around the film to dam the liquid toner so that there is a toner chamber 22 formed within the border and between the plate 20 and the coating 16. Other means are feasible.

A typical spacing between the plate 20 and the surface 18 to form the vertical thickness of the chamber 22 is 0.005 to 0.020 inch. The plate 20 may be termed the image intensification plate for reasons which presently will appear.

Just after the latent image has been produced but before the toner is flooded into the chamber 22 there is a toner repelling bias applied between the ohmic layer 14 and the plate 20. This bias, in the case of the apparatus of the invention which is here illustrated and explained as an example, is achieved by connecting the ohmic layer 14 through a conductor 24 to the positive side of a potential source 26 and the plate 20 by way of the conductor 28 to the negative terminal of the source 26. In the case illustrated, this latter connection is through ground, shown symbolically.

The potential may be anywhere between 5 and 30 volts, depending upon the conditions of the various parameters involved. The effect of the bias is most strongly felt close to the ohmic layer 14 and furthest from ground and, when the bias has been established the liquid toner is run into the chamber 22. FIG. 1 illustrates conditions just before the toner has flooded the chamber 22, the toner being shown at 30 in FIG. 2 and not at all in FIG. 1.

In FIG, 2, the toner has been flooded into the chamber 22 and is contained therein. Such containment could be based upon surface tension, for example.

The effect of the bias is not obvious unless one considers the nature of the phenomena which occur. Where charge exists on the surface 18 (or slightly below), the bias potential will have substantially no effect. The toner particles, being positively charged, are still attracted in accordance with the differences between the amount of charge at the respective increments. Where charge has been dissipated due to the effects of light photons affecting the increments and causing recombination of electrons, there is no surface potential or very little without the bias. The bias renders these low or zero charge increments slightly positive, and since the toner particles are positively charged also, they are repelled from those areas.

One may consider that the entire base line of the charge-carrying surface is lowered slightly below zero potential without in any way changing the gradients or relative charge differences between increments so that the relative amounts of toner paticles attracted by and adhered to the several increments are not affected; but since the increments which would otherwise be at zero or slightly negative surface potential are now slightly positive, toner particles are repulsed from these latter increments instead of being attracted to them.

Figure 3:
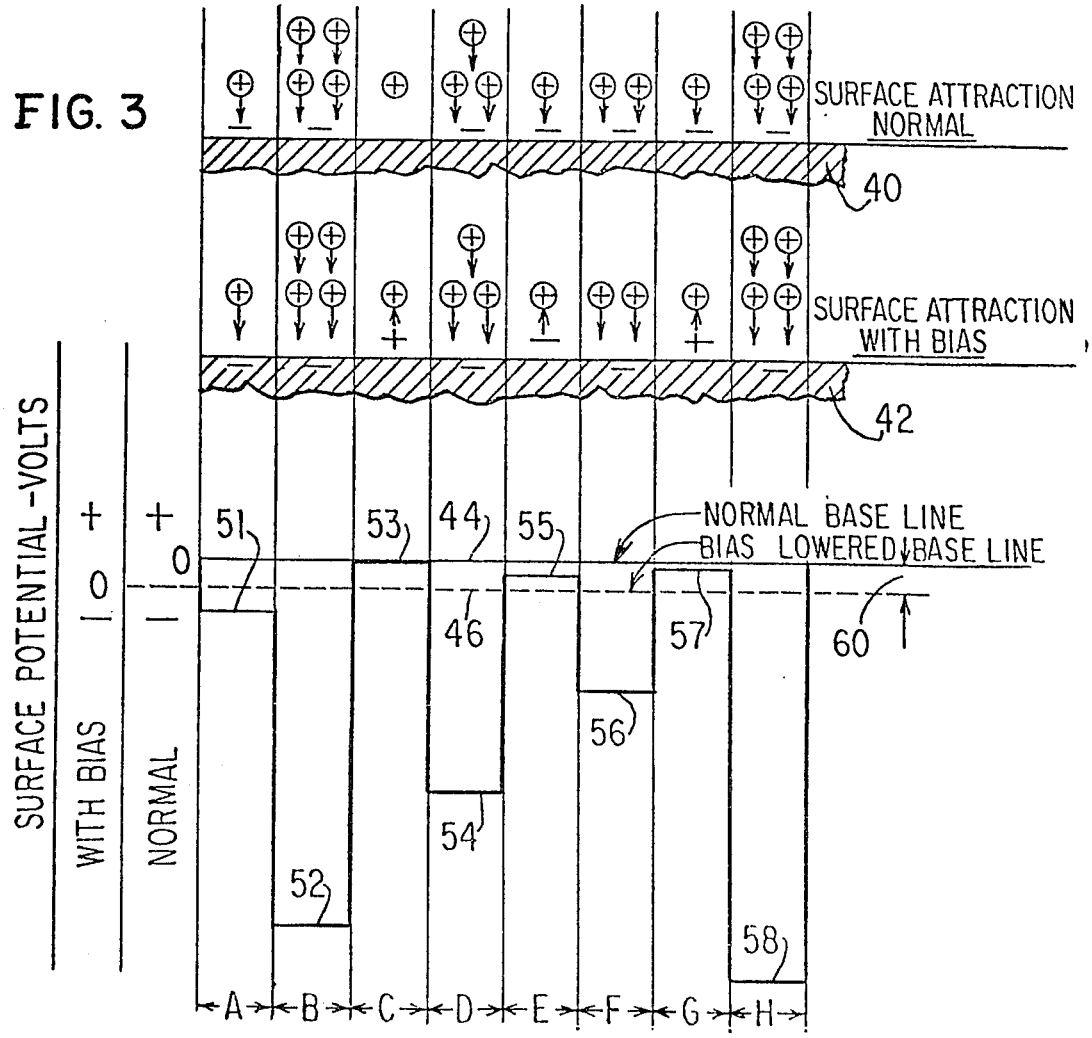
FIG. 3 is a chart used in explaining the method of the invention and the operation of the apparatus thereof.

This entire phenomena can be seen in the bar chart which is shown in FIG. 3. Here the surface is shown at 40 and 42 aligned with the columns that represent adjacent increments. The upper surface 40 represents the surface attraction or repulsion of positive toner particles with no bias, called "normal." The lower surface 42 represents the surface attraction or repulsion of positive toner particles when there is a bias. The areas across the chart designated A to H inclusive represent 8 increments of the surface 18. The lower portion of the chart shows the normal base line 44 which is presumed to be zero potential and the base line 46 as a broken line a slight voltage below the normal base line by a voltage representing the bias.

The lower bars are an attempt to illustrate graphically the total charge of the respective increments represented by the latent image. Only the solid line bars are shown and change in their values is a relative concept related to the base line to which they are referred.

The small charged circles above the surfaces 18 represent quantities of toner particles which will be attracted or repelled. The net charge of each increment is represented by the polarity sign adjacent the surface lines 18 at each increment.

Assume that the level of charge voltage of the surface 18 without bias for the various increments relative to the normal base line 44 is at 51 to 58 respectively for the increments A to H. Obviously, the surface at 40 will in all such cases be either at a net voltage of a negative polarity or no polarity where the charge has totally been dissipated. Thus, at A, B, D, E, F, G and H the polarity is shown by a negative sign at the surface 40, the increment C having no polarity sign. The voltage levels are of different values. Levels 52, 54 and 58 are quite negative, representing very little light having reached the increments; levels 55 and 57 are quite small but not zero; level 53 is at zero potential having been fully discharged; and the level 56 is at a moderate negative potential. All of these relate to the base line 44.

Now consider the attraction of the positively charged particles. It is seen that the number of small circles with plus signs shown is a rough measure of actual number of degree of attraction for the particles. Above surface 40, at A one circle is shown with an arrow pointed downward, indicating attraction. At increment B there are four such circles with their arrows pointed downward; at increment D there are three circles, etc. All increments have attraction for particles except for the increment C which shows a circle with a plus sign but no arrow. This represents a condition where there is no charge, but where there will be toner particles floating in the dispersant. The increments E and G have so little surface voltage that there is no benefit to having these increments toned since they probably represent some totally blank background anyway.

The increments E and G under normal conditions will attract toner particles, and as for the increment C, toner particles will fall out of the dispersant when it evaporates to color this increment as well as the others.

Now consider the addition of the bias voltage, which lowers the base line to 46. This in effect raises the surface voltage of all increments by a slight positive amount. The net result of this is that all of the levels 51 through 58 are raised by the positive voltage 60. Voltages 51, 52, 54, 56 and 58 will still be negative and their relative charges will remain the same. Their net surface charge will still be negative, and the minus sign adjacent the surface 42 for these increments indicates this. The small circles in these incremental spaces are all still pointed downwardly, indicating attraction of toner particles to the surface 42. As for the levels 53, 55 and 57, these are now all above the base line 46 and hence have net positive charges. This is indicated by the plus signs adjacent the surface 42 in these incremental areas. As a result, the positive potential of the surface will repel toner, and the small circles with plus signs are shown pointed upward in each of these three incremental areas.

As a result of the bias as described, the incremental areas which are intended to provide blank backgrounds are quite clean since the toner particles are repelled from these areas without affecting the relative amount of toner adhered to the photoconductive coating in other areas of the film.

Figure 2:
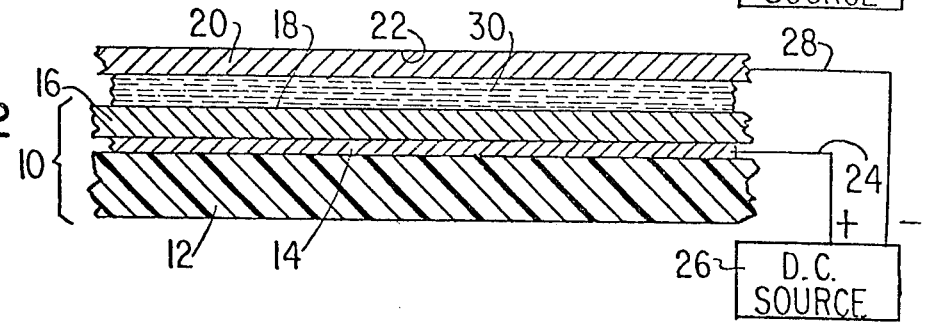
FIG. 2 is a view similar to that of FIG. 1 but showing a subsequent step of the method.

Continuing with a description of the method of the invention, the condition in FIG. 2 is that the surface 18 is attracting toner particles where there is net charge of a voltage that is more negative than the amount of the positive bias afforded by the source 26, all other increments having a small positive charge which repels the positively charged toner particles.

This condition is permitted to obtain for a period of time which is considered sufficient to tone the image. In a typical case where the film of the copending application is used, the imaging time may be about 100 milliseconds. In other instances the time may be somewhat longer. The toner bias is applied to the film and the image intensification plate 20 as soon as possible before toning. This could be a condition that is brought about when the image intensification plate is moved into position over the film 10 so that conceivably the bias may be applied by such movement. The exposure should be complete at this time. In the case of high speed film it is desirable that there be no hiatus between the termination of exposure and the commencement of the toning period. Suitable mechanism can be devised to accomplish this which at the time will apply the required bias to repel "floating" toner particles.

The toning period for such high speed film can be of the order of one half to one second. Other films may require longer toning periods. The bias referred to stays on during this period, as a result of which the incremental areas with positive charge attract no toner particles.

At the end of the toning period, as measured by the parameters of the film and the characteristics of the toner, the bias voltage is suddenly increased. This condition is indicated in FIG. 4. Here particles of toner from the body of toner 30 have been deposited on the surface 18 at incremental areas which were charged predominently negative. These areas are indicated at 64. The toner dispersant still carries particles floating therein which have been repelled from the positively biased areas. There is still some danger that there will be a deposit of them in blank areas of the image after toning. Accordingly, when the bias voltage is increased the effect is that all the positively charged toner particles are attracted to the bottom surface 66 of this plate and will adhere to it. As a result the dispersant in the chamber 22 is cleared of floating toner particles.

The voltage of the particle-clearing bias is higher than the bias previously applied by the source 26 and is of the same polarity. It remains in place while the now clear dispersant is decanted or drawn out of the chamber 22. This is shown in FIG. 5 where the adhered toner particles are shown at 68 on the bottom surface 66 of the plate 20, the dispersant of toner 30 now being drawn off as indicated by the arrow 70. This can be effected by vacuum, pressure, capillary action or a combination thereof. For example, the damming means could be highly absorbent of the dispersant so that it literally sucks the dispersant into itself when the plate 20 is suitably moved to break the surface tension. The liquid film of dispersant which may remain on the surface 18 will have no particles in it, hence when such film evaporates, there will be no "fall-out" of particles onto the background areas which are intended to be blank. The time for the attracting bias, as it might be called depends upon the time to eliminate the toner dispersant which could be of the order of one second.

The image intensification plate 20 is normally a permanent part of the camera or other imaging device with which the invention is associated. The accumulated toner particles 68 on its lower surface are readily wiped off from time to time but the accumulation is so slight that this need not be done for substantial periods of time. Mechanism can readily be devised to do so when film members are placed in position or when cartridges of film are introduced into the apparatus.

The practical application of the invention to a suitable reproducing apparatus or camera will take a large variety of forms. For demonstrating the ease with which the method of the invention may be used in a relatively simple apparatus, reference may be had to FIGS. 6 and 7 which are fragmentary views of the essential portions of apparatus embodying the invention.

In FIG. 6 there is illustrated in sectional fragmentary view the apparatus 80 which may be considered part of a larger structure comprising a camera or other imaging device. What is shown here is an electrophotographic member 10 in which the various layers or coatings 12, 14 and 16 are not shown for simplification. This electrophotographic member 10 is preferably of the construction of the copending application. It is mounted on a suitable framing structure 82 whose framing side parts are shown in section at 84 and 86 and in elevation at 88. As shown in FIG. 7, the framing structure 82 cooperates with the image intensification plate 20 when the latter is in position directly over the active photoconductive surface 18 of the film member 10 to dam the liquid toner 30, thus forming the chamber 22 mentioned above in connection with the description of FIGS. 1, 2, 4 and 5.

The image intensification plate 20 is arranged to move relative to the film 10 to cover the exposed or framed portion of the film surface 18 (i.e., that area which is not blocked by the framing side parts of the framing structure 82). This movement can be either a sliding movement as indicated by the broken line fragment 20' in FIG. 6 moving to the left following the arrows; it could be effected by a rotation bringing the plate 20 into position; it could be achieved by a translated movement; or by a combination of any of these. In FIG. 7 the means for moving the image intensification plate 20 into position is symbolically illustrated by the linkage mechanism 90 connected thereto. The electrical lead 28 is shown in FIG. 7 along with its companion lead 24, the latter being connected to the ohmic layer 14 which is not detailed in FIG. 7.

In FIG. 6, the particular embodiment 80 includes a pod or bag 92 of liquid toner 30 that is adhered to the upper surface of the framing side part 84. The bag can be made out of any flexible synthetic resin that is not affected by the hydrocarbon dispersant of the toner it carries. For example, polymerized resins of the Mylar (DuPont) type would be suitable. There is a weakened lip at 94 which overhangs a slight groove 96 provided in the side framing part 84 where it faces the chamber 22. When the metal image intensification plate 20 is pushed into position to enclose the chamber 22 by the mechanism 90, the leading edge 100 pinches the lip 94 and ruptures the bag so that the liquid toner 30 floods into the chamber 22, now closed by the plate 20. The ruptured bag is shown at 92' in FIG. 7.

The bag 92 may be a very small one attached to each film frame 82 or it can be a supply in the form of a perforated, normally enclosed article which is "milked" or drawn upon by the mechanism which operates the plate 20. It is feasible to have the toner in a crushable member where it is encapsulated as an assembly of respective dry and liquid particles to be mixed when crushed and released. Many variations will occur to those skilled in this art. For example, plate 20 may be foraminous and the toner expressed through it.

The inner surfaces of the framing sides may be treated with a material such as shown at 104 that slowly dissolves in the dispersant or retards the absorbing of the toner by the framing structure 82 for a time sufficient to enable the toning to take place. It has been found that even where the material of the framing structure 82 is highly absorbent, as for example, made out of a very absorbent and/or porous cellulose or paper, if the transverse dimension of the chamber 22 is of the order of about 0.4mm the surface tension of the toner 30 itself will retain the body of toner in the chamber until surface tension is relieved by removal of the plate from the chamber. At this point, the dispersant remaining will quickly be absorbed into the side parts 84, 86 an 88. This is a capillary action phenomenon.

The sliding movement of the plate 20 is helped by providing a layer 106 of Teflon or other "slippery" material on its bottom side. Since the particles of toner which are attracted by the action of the counter-bias will adhere to the bottom surface of the plate 20, the presence of a non-wettable surface material makes them easy to remove. This can be done, as mentioned, either periodically by any suitable means or even by the bringing into position of the next electrophotographic member 10 and its frame 82. The leading edge of the frame 82 or the carrier for the frame, shown at 108 in FIG. 7, can be arranged to wipe the bottom surface of the plate free of toner particles from the previous toning operation as the two are moved relative to one another. This is shown at 110 in FIG. 6 where the toner particles were removed by an exterior edge of the frame 82. The amount of toner particles is so little that the accumulation from one toning is not even noticeable.

The carrier 108 is moved relative to the plate 20 by any suitable mechanism such as shown at 112 as an alternate to or in addition to the mechanism 90.

The practical construction of the apparatus of the invention has involved film 10 and framing members 82 of relatively small size. The film is of the size which is known as "110," having approximately the exposed dimensions of 12 by 16 mm with the framing member 82 being of the order of 18 by 25 mm. A typical framing member of paperboard would be about 1.5 to 2 mm thick. Cellulosic members might be somewhat thicker, but must have sufficient rigidity to support the electrophotographic film during use and thereafter to enable display, enlargement, etc. Larger film members can be toned by the invention.

The electrical connections for establishing the imaging and clearing biases may be of the construction which is illustrated in FIG. 8, this being a highly simplified circuit diagram. The plate 20 and film member 10 are generally illustrated as blocks. Obviously some structure is required to enable these members to be moved relative to one another without inadvertently removing the connections which have been established. Likewise, the connection to the film member 10 must be such that it is automatically established when the film member is changed. This is within the skill of those in this art.

A d.c. source 120 is shown as a battery having a tap 122 and terminals 128, 130 representing different voltage values. The desired voltage values are chosen by simple experiment and are established as the terminals 26 and 62, providing a positive voltage source of one voltage value in one case and positive voltage source of a higher value in the other case.

A switch is shown at 126 with one terminal 132 connected respectively by the lead 24 to the film 10. The plate 20 is connected by lead 28 to the negative terminal 128 of battery 120. Terminal 26 is connected to the positive terminal 130 of the battery 120.

This arrangement is intended for a method and apparatus wherein the photoconductive coating is of n-type so that the toner particles are required to have positive charges and will be attracted to negatively charged increments of the film 10. When the repulsion bias is desired, the switch 126 is thrown to the terminal 62. This connects the ohmic layer 14 of the film 10 to the tap 122 while at the same time connecting the plate 20 to the negative terminal 128. When the clearing bias is desired, the switch 126 is thrown to terminal 26. This connects the ohmic layer 14 of film 10 to the positive terminal 130 of the battery with the plate 20 still connected to negative terminal 128.

The electrical field which exists across the intervening space of the chamber 22 in both cases is of the same polarity, but the magnitude relationship changes in both cases. In the beginning of the toning operation the activity occurs closest to the surface 18 and it is desired to clear out the most brightly illuminated areas; at the end of the toning period when the majority of toner particles have settled onto the surface 18 in response to the charge image, it is desired to sweep the floating particles out of the liquid remaining in the chamber 22. At this time, the higher biased force is desired to attract the particle from the toner suspension to the plate. The toner particles that are forming the image will remain on the film during the clearing period due to the fact that they are being held on to the cadmium sulfide surface not only by the field, but by Vanderwaals forces also (field strength increases by $1/r^2$, $r$ = distance from surface).

In the practical device, the switching can be done electronically and automatically. The polarities can be changed readily for use with p-type photoconductive materials.

As a summary of the procedure which occurs during the process of making a complete toned film, the following is submitted:

1. The film 10 is charged and exposed to a projected image by any suitable apparatus.
2. Immediately that the exposure is completed, the image intensification plate 20 is moved into position relative to the surface of the film.
3. When the plate 20 is in position, the image intensification repulsion or imaging bias is applied, although it can be applied all the time.
4. Toner 30 is run into the chamber 22 while the image intensification imaging bias is still being applied. FIG. 2 shows this.

The timing of the above four steps depends upon the chracteristics of the film and the practical aspects of moving physical things in the performance of the described functions. Assuming a very high speed film, ideally the instant that the exposure is complete the image intensification bias and toning can start. In a practical consideration, there is a finite time required to move the plate 20 into position and introduce the toner. On this account, the image intensification bias can be applied just before the toning begins.

5. The toning period is completed with the image intensification imaging bias in place, but just before the liquid toner is removed from the chamber 22 the bias potential level is increased. This is shown in FIG. 4.
6. With the higher bias potential, the toner 30 is removed from the chamber 22. This is shown in FIG. 5. Thereafter the process is complete and the toned film member may be dispensed from the camera. The clearing or attraction bias may be removed at any convenient time after the liquid has been drawn off because it ceases acting on floating particles as soon as the chamber 22 is empty. As a practical matter there are practically no remaining particles in the toner 30 so that it is clear dispersant.

The steps which occur after the imaging or exposure obviously occur in darkness and the apparatus should be constructed to assure that there is no leakage of light. Since the chamber 22 is substantially enclosed on all sides, this is relatively an easy condition to achieve.

In the case of toners in which the particles do not adhere to the film surface after the completion of toning, there would be a fixing or fusing of the toner to the surface 18 by a heat lamp or the like, either within the camera apparatus 80 or on the outside thereof. Transfer can be effected, if desired, by pressing the film surface against a receptor.

Many variations are readily achieved without departing from the spirit or scope of the invention as defined in the appended claims.

What it is claimed and desired to secure by Letters Patent of the United States is:

1. A method for toning the latent image on a charged electrophotographic member which has been exposed to a radiation pattern which members includes an ohmic layer and a photoconductive coating, the latent image being formed by selective charge distribution in the photoconductive coating in increments dependent upon the amount of radiation received and to selectively attract toner particles of one polarity related to the charge acceptance characteristic of the coating for each increment of charge at the surface in inverse relation to the amount of radiation received by that increment, said method comprising: bringing a conductive plate into juxtaposed parallel relation with the surface of the coating to define a liquid toner retaining volume, applying a low d.c. bias voltage between the plate and ohmic layer of said one polarity and of a value and relationship such as to effect an imaging bias to repel toner particles from said surface at those surface increments which received the most radiation during exposure without substantially changing the overall relative attraction pattern of toner particles at the remaining surface increments, introducing into said volume liquid toner comprising particles of said one polarity and in a dispersant medium, retaining the liquid toner in the volume for a period of time which will substantially fully tone the latent image while at the same time maintaining said low d.c. bias for at least the majority of said period while also maintaining the positional relationship of said plate and coating, and establishing a clearing bias by increasing imaging bias to a condition such that its polarity and the voltage relationship between the plate and the ohmic layer favor attraction of particles to said plate and thereafter removing the liquid remaining in said volume after said period.

2. The method as claimed in claim 1 in which the imaging bias is applied before the liquid toner is introduced into said volume.

3. The method as claimed in claim 1 in which the imaging bias is maintained beyond the said period of time to tone the latent image.

4. The method as claimed in claim 1 in which the clearing bias is maintained for a period of time sufficient to sweep floating toner particles out of said liquid before removing the liquid.

5. The method as claimed in claim 1 in which the photoconductive coating is of n-type, the imaging bias is provided from a first source of positive d.c. potential and the clearing bias is provided from a second source of positive d.c. potential of greater magnitude.

6. The method as claimed in claim 1 in which the plate is withdrawn from position relative to the surface of the coating for use in a subsequent toning and carries attracted toner particles with it.

7. The method as claimed in claim 6 in which the toner particles are removed from the plate after being withdrawn and before being used again.

8. Apparatus for toning the latent image on a charged electrophotographic member which has been exposed to a radiation pattern which member includes an ohmic layer and a photoconductive coating, the latent image being formed by selective charge distribution in the photoconductive coating in increments dependent upon the amount of radiation received and to selectively attract toner particles of one polarity related to the charge acceptance characteristic of the coating for each surface increment in inverse relation to the amount of radiation received by that surface increment, and said apparatus including means for charging and exposing the electrophotographic member, and comprising:

A. an image intensification plate of conductive material,

B. carrier means for supporting an electrophotographic member as described above, C. means for moving the carrier means and plate into parallel juxtaposed spaced relationship to define a toner chamber, the photoconductive coating of said electrophotographic member being disposed with the surface thereof facing inwardly of the chamber and opposite a face of said plate, D. a first source of d.c. potential of relatively low voltage having positive and negative terminals, the value of voltage being such that if applied to said ohmic layer as a bias for said surface as will not materially affect the relative charge potentials of the increments forming the latent image on said surface but will cause the repelling of particles of toner at those increments which have little or no charge, E. means for introducing liquid toner comprising particles in a dispersant into the chamber for the purpose of toning the latent image on the said surface of said electrophotographic member, F. means for connecting the first source of d.c. potential source to said ohmic layer across said plate whereby to establish a repelling bias for toner particles in the proximity of said surface at those increments and maintaining said bias for a substantial pottion of the time period while said liquid toner is in the chamber to tone the latent image, G. a second source of d.c. potential of higher voltage than the first source, H. means for disconnecting the d.c. potential of said first source and for connecting said d.c. potential of said second source whereby to attract toner particles in said dispersant to said plate and I. means for removing the liquid remaining from said chamber.

9. The toning apparatus as claimed in claim 8 in which the means for disconnecting of the first source and the means for connecting of said second source operate simultaneously.

10. The toning apparatus as claimed in claim 8 in which the first d.c. source is a positive voltage source.

11. The toning apparatus as claimed in claim 8 in which the first d.c. source is a positive voltage source and the second d.c. source is a positive voltage source of higher potential.

12. The toning apparatus as claimed in claim 8 in which the means for introducing liquid toner are arranged to be actuated by one of said plate and carrier means when the plate and carrier means have fully moved to their parallel juxtaposed positions.

13. The toning apparatus as claimed in claim 8 and in combination with an electrophotographic member mounted in a framing structure, the framing structure being disposed in said carrier means to move therewith, the said chamber being formed by the inner edges of the framing structure, the surface of said photoconductive coating and said plate.

14. The toning apparatus as claimed in claim 13 in which the framing structure is of a highly absorbent material and the means for removing the liquid toner include the framing structure.

15. The toning apparatus as claimed in claim 13 in which the liquid toner is contained in an enclosure secured to the framing structure and said liquid toner introducing means act on said enclosure to obtain access thereto and to express the liquid toner therefrom.

16. The toning apparatus as claimed in claim 8 in which the means for moving the carrier means and plate are arranged to move them in parallel planes.

17. The toning apparatus as claimed in claim 8 in which the surface of said plate facing into the chamber is provided with a nonwettable coating.

18. Apparatus for imaging by electrostatic means which comprises:

A. means for charging an electrophotographic member,

B. means for exposing said member to radiation to achieve a latent image on a surface of said member, C. means forming a toning chamber with said member and including a conductive plate parallel to said surface and relatively close to said surface, D. means for introducing liquid toner into said chamber and permitting same to remain for a period of time required to achieve toning of said latent image, E. means operating in the said period of time for biasing the member relative to the plate with a d.c. repulsive bias of a voltage sufficiently high at the surface to repel toner particles from those areas of said member which received the highest radiation but without changing the relative charge relationship over the latent image area, F. means for removing the first mentioned bias after at least the majority of said period of time has transpired and for applying a second bias to the plate relative to said member increasing the overall effective bias to attract particles to said plate for removing them from said liquid toner, G. means for running the remaining liquid out of the chamber, and H. means for moving said member out of its relationship with said plate.

19. The apparatus as claimed in claim 18 in which the second bias is effected just prior to running the toner out of said chamber.

* * * * *